US006138798A

United States Patent [19]

Macuga

[11] Patent Number: 6,138,798

[45] **Date of Patent: *Oct. 31, 2000**

[54] ELEVATOR SAFETY SYSTEM INCORPORATING FALSE PIT

[76] Inventor: Henry J. Macuga, 5 Maple St., Ware, Mass. 01082

[ * ] Notice: This patent is subject to a terminal disclaimer.

[21] Appl. No.: 09/007,170

[22] Filed: Jan. 14, 1998

Related U.S. Application Data

[63] Continuation of application No. 08/577,844, Dec. 22, 1995, Pat. No. 5,806,633.

[51] Int. Cl.[7] ..... B66B 1/28

[52] U.S. Cl. ..... 187/294; 187/357; 187/390

[58] Field of Search ..... 187/294, 392, 187/279, 282, 289, 343, 414, 299, 306, 314, 348, 353, 356

[56] References Cited

U.S. PATENT DOCUMENTS

| | | | |
|---|---|---|---|
| 406,630 | 7/1889 | Cowie . | |
| 642,448 | 1/1900 | Holmes . | |
| 692,888 | 2/1902 | Moses . | |
| 787,258 | 4/1905 | Austin . | |
| 1,614,675 | 1/1927 | Jones . | |
| 2,053,954 | 1/1936 | Lindahl . | |
| 4,015,689 | 4/1977 | Johnson | 187/1 |
| 5,283,400 | 2/1994 | Leone et al. | 187/140 |
| 5,644,111 | 7/1997 | Cerny et al. | 187/393 |
| 5,727,657 | 3/1998 | Foelix | 187/356 |
| 5,773,771 | 6/1998 | Chatham | 187/282 |
| 5,806,633 | 9/1998 | Macuga | 187/357 |

FOREIGN PATENT DOCUMENTS

| | | | |
|---|---|---|---|
| 1-313292 | 12/1989 | Japan | 187/392 |
| 2-169482 | 6/1990 | Japan | 187/392 |
| 3-158370 | 7/1991 | Japan | 187/279 |
| 169887 | 10/1921 | United Kingdom . | |

*Primary Examiner*—Jonathan Salata

*Attorney, Agent, or Firm*—Jacobson, Price, Holman & Stern, PLLC

[57] ABSTRACT

The elevator safety device creates a false pit beneath the elevator frame using left and right laterally-spaced, fixed stop members fixedly attached to the car frame, and left and right laterally-spaced safety columns affixed to the pit floor and pivotable between an extended position in vertical alignment with the left and right stop members, respectively, and a retracted position clear of the car, the frame, and the left and right stop members. The safety columns are bumper-type devices designed to support full car weight should the need arise, and provides the ASME A17.1 minimum depth of pit for the refuge area. Actuators are operatively connected to the safety columns to pivot them between their extended and retracted positions. A pressure-sensitive detector located on the pit floor below the car detects the presence of a person on the pit floor. The actuators are electronically activated to pivot the safety columns from their retracted to their extended positions. Left and right laterally-spaced, movable stop members are attached to the rails which guide vertical movement of the car, and are movable between a first position in vertical alignment with the car frame and a second position clear of the frame, to prevent downward vertical movement of the car below the stop members. The elevator safety system also includes an electric alarm bell, key-activated switches, and electro-mechanical relays. An ancillary AC power source of 120 volts operates the elevator safety system.

8 Claims, 9 Drawing Sheets

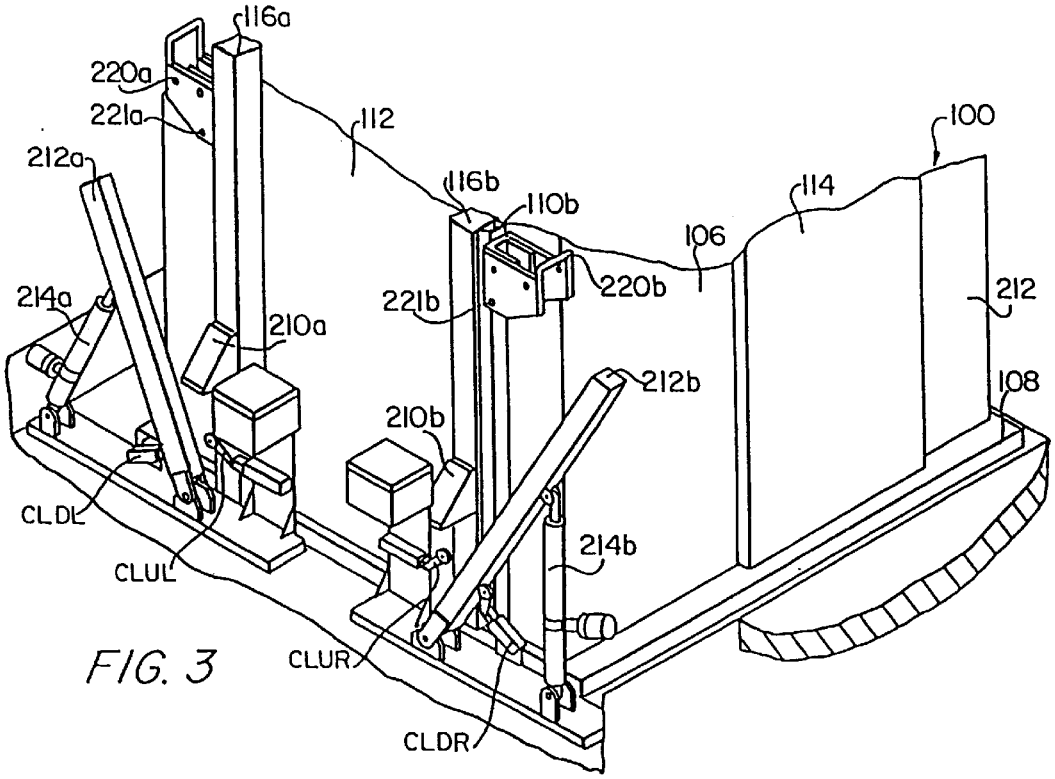
FIG. 3
FIG. 2
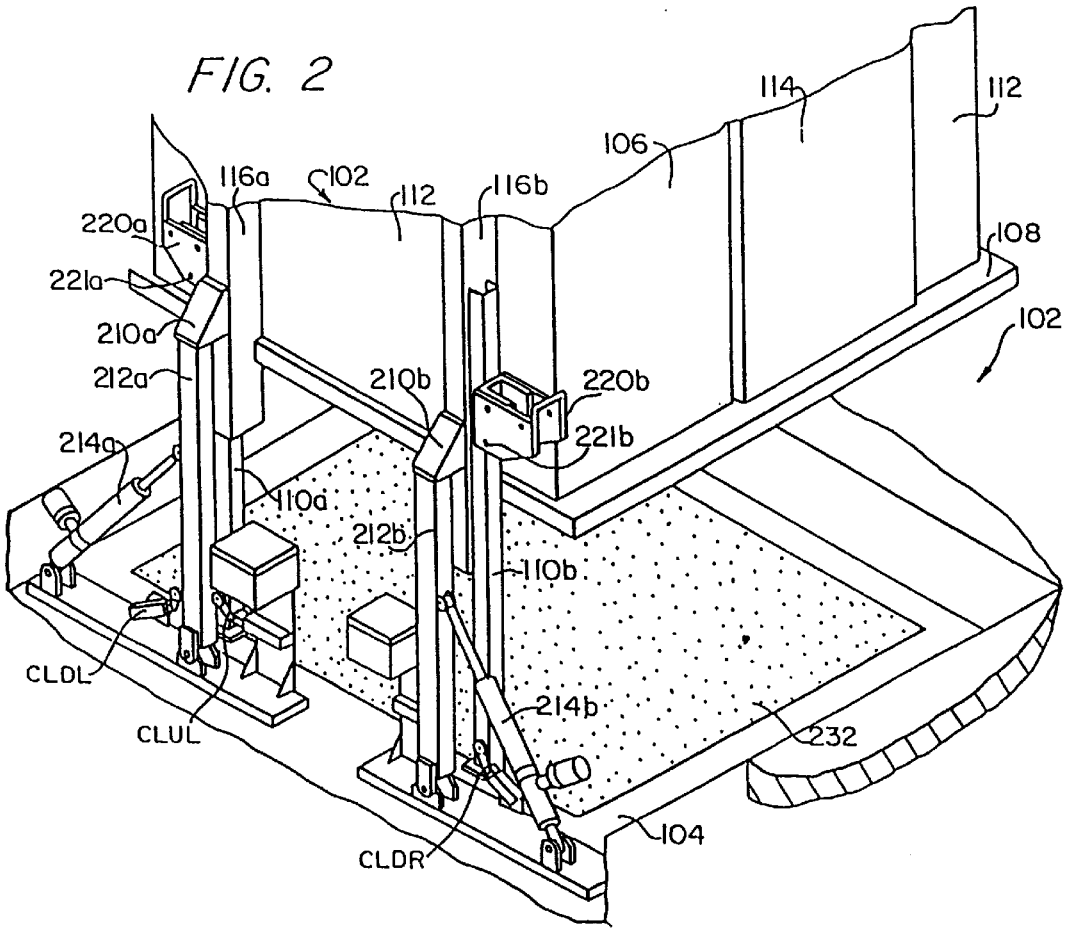

242
102
100
112
116a
116b
106
110b
110a
220b
220a
221a
210b
221b
210a
108
120a
120b
212a
212b
214a
214b
CLUL
CLUR
104
222a
CLDL
222b
CLDR 242
102
100
116a
112
110a
116b
110b
106
220b
220a
221a
221b
212a
212b
210a
210b
214a
214b
120b
120a
104
222a
CLDL
CLUL
CLUR
CLDR
222b

SAFETY MAT SWITCH
230
SMS1
SMS2
MR
244
242
246
WARNING BELL
248
MRR2
MRR3
PE3
MRR
LATCHING RELAY
MRR1
PE
REQUIRED INDICATOR
RESET
250
252
MR1
MR2
MR3
MR4
SMR1
SMR2
SML1
SML2
UC1
DC1
EXT1
CLR1
DE1
214a
AML
ACTUATORS
AMR
214b
MR5
BAC1
BAU1
BAD1
EXT2
CLR
EXT
RET
DE
DI
UI
EXT3
EXT4
RET1
RET2
CL
CLUL
CLUR
CLDL
CLDR
PROGRAMMABLE CONTROLLER AC SUPPLY
MCR2
UC
PC
DC
PI
DE2
DC4
UC4
U2
UC5
DC5
D2
MCR1
PE1
RPR1
OL1
TO FIG. 10B
HOIST MOTOR
OL
UC2
DC2
UC3
DC3
PC1
PC2
PC3
RPR

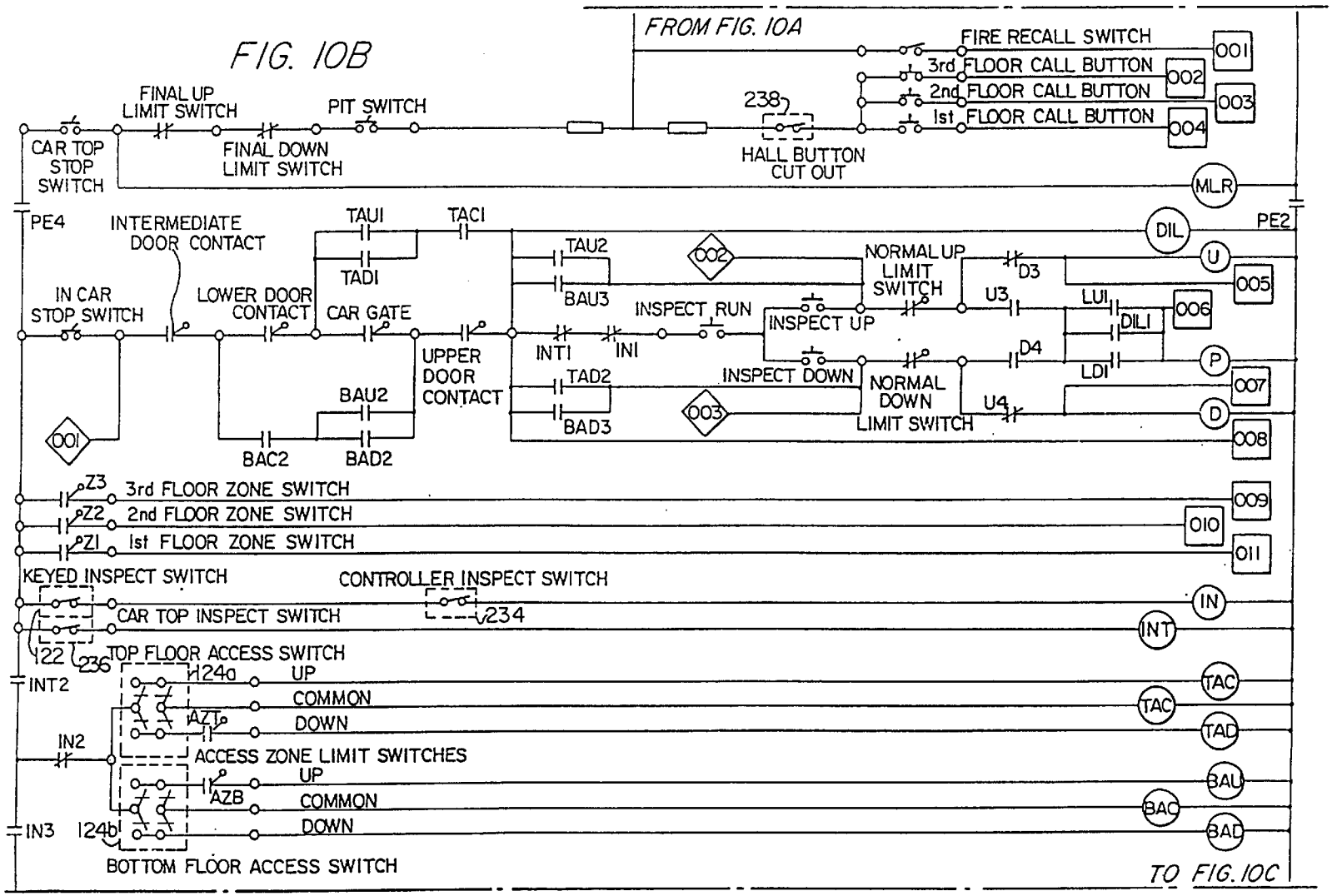
FIG. 10B
FROM FIG. 10A
TO FIG. 10C
FIRE RECALL SWITCH
3rd FLOOR CALL BUTTON
2nd FLOOR CALL BUTTON
1st FLOOR CALL BUTTON
HALL BUTTON CUT OUT
PIT SWITCH
FINAL DOWN LIMIT SWITCH
FINAL UP LIMIT SWITCH
CAR TOP STOP SWITCH
INTERMEDIATE DOOR CONTACT
LOWER DOOR CONTACT
IN CAR STOP SWITCH
CAR GATE
UPPER DOOR CONTACT
NORMAL UP LIMIT SWITCH
NORMAL DOWN LIMIT SWITCH
INSPECT UP
INSPECT DOWN
INSPECT RUN
3rd FLOOR ZONE SWITCH
2nd FLOOR ZONE SWITCH
1st FLOOR ZONE SWITCH
KEYED INSPECT SWITCH
CONTROLLER INSPECT SWITCH
CAR TOP INSPECT SWITCH
TOP FLOOR ACCESS SWITCH
ACCESS ZONE LIMIT SWITCHES
BOTTOM FLOOR ACCESS SWITCH
UP
DOWN
COMMON

ELEVATOR SAFETY SYSTEM INCORPORATING FALSE PIT

This is a continuation of U.S. application Ser. No. 08/577,844, filed Dec. 22, 1995, now U.S. Pat. No. 5,806, 633, issued on Sep. 15, 1998.

BACKGROUND OF THE INVENTION

1. Field of the Invention

The present invention relates to elevator safety systems. More specifically, the invention relates to an elevator safety system incorporating a false pit for use where circumstances prevent the construction of a standard safety pit.

2. Related Art

The safety code for elevators and escalators (ASME A17.1) requires a "minimum bottom car clearance" above an area with a physically restricted pit depth. Pit depth can be limited by a variety of conditions, including but not limited to pre-existing construction, a building structure, a geological formation such as bedrock, or a locally high water table. Attempting to install a minimum pit depth under these conditions often results in financial burdens which cause the delay or cancellation of installation. Financial burden can result from the need to use explosives to eliminate a large boulder or bedrock. However, in the case of a high water table, there is no solution readily available, except to relocate or redesign the building structure.

Another factor to be considered is the need to meet minimum standards of accessibility for the handicapped or physically impaired. An elevator often will provide the needed accessibility. However, in a pre-existing facility, there may be obstacles to placement of an elevator. One such obstacle is the minimum pit depth to allow for the minimum bottom car clearance.

Among the relevant portions of ASME A17.1 are Rule 106.1(g) of Section 106 and Rules 107.1 and 107.1(d) of Section 107. In summary, these rules require that a cardboard box measuring either 24 inches wide×48 inches long×24 inches high or 18 inches wide×36 inches long×42 inches high must fit beneath the car platform frame without contact when the car is at its lowest possible elevation in the hoistway. The full refuge area must be available even if the normal method of suspending the car is absent due to mechanical failure, periodic maintenance, or for scheduled replacement as is done with hoisting ropes.

In a conventional elevator system, rubber bumpers or spring buffers mechanically limit the car's lowest elevation in the hoistway. The height of the refuge area must meet the code specifications when the car is resting on the bumpers or the fully compressed spring buffers. The car frame size measured horizontally left to right and front to rear has a direct bearing on which refuge area is available. A minimal car platform size would mandate a 42 inch high refuge area, while a larger car platform would allow for a 24 inch high refuge area.

The concept of manual catches which rotate into the elevator shaft to prevent the elevator car from descending is well-known, as is the concept of supporting the elevator car on an arm. For example, U.S. Pat. No. 2,053,954 to Lindahl discloses an arrangement in mining elevators in which an arm rotates out into an elevator shaft to hold the car at a specific location. The arm is able to rotate after the elevator has slowed to a predetermined speed and a worker has manually actuated a lever. U.S. Pat. No. 787,258 Austin discloses a protrusion which supports an elevator in the event that the elevator rises above the protrusion and breaks the supporting cable. U.S. Pat. No. 692,888 Moses discloses support arms embedded in the shaft wall which rotate out to support the elevator when it is located at the top of the shaft U.S. Pat. No. 642,448 Holmes discloses a safety device for elevators in which many levers are embedded in the shaft wall, and can rotate out to engage the edge of the elevator car in an emergency situation. U.S. Pat. No. 406,630 Cowie discloses a safety catch for use in the event of overwinding the elevator cable. The safety catch includes a guide with a shoulder which catches the elevator if the base of the car has risen past the top of the shoulder.

However, the primary concern of the above-described patents is either to catch the elevator at the top of the shaft in case of overwinding of the elevator cable, or to hold the car steady at a particular stop. None of them is directed to providing an area of safety at the terminus of the shaft, or teaches or suggests the means to do so.

The ASME A17.1 safety code for elevators and escalators is constantly evolving to keep pace with new technologies, processes and re-examination of the standards with which elevator and escalator installations must comply. Thus, the ASME A17 Cod especifically states: "Where present rules are not applicable or do not describe the product or system, the enforcing authority should recognize the need for exercising latitude and granting exceptions where the product or system is equivalent in quality, strength or stability, fire resistance, effectiveness, durability, and safety to that intended by the present Code Rules." The present invention takes advantage of this provision to provide an elevator safety system under circumstances where a conventional four (4) foot minimum pit depth cannot be achieved due to pre-existing conditions.

SUMMARY OF THE INVENTION

The elevator safety device in accordance with the present invention electro-mechanically creates a false pit beneath the elevator frame. The false pit created includes a bumper-type device designed to support full car weight should the need arise, and provides the ASME A17.1 minimum depth of pit for the refuge area. The elevator safety device in accordance with the present invention accomplishes this task automatically if the car is above the pit floor high enough to allow the positioning of motor driven actuators coupled directly to columns that support the elevator. Two manually operated devices are provided for the safety of the individuals who maintain and repair the elevator installation. These manually operated devices are on the elevator guide rails or other suitable structure at a higher elevation to allow a person to stand upright.

The elevator safety system in accordance with the present invention additionally includes an electric alarm bell, a pressure-operated mat switch, key-operated switches, and electro-mechanical relays. An ancillary AC power source of 120 volts operates the elevator safety system. The elevator operating voltage, provided by commercial power and the ancillary AC power source must be continuously available for the elevator to operate.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 2 is a perspective view of the conventional elevator and the firstvator safety system of FIG. 1, with the safety columns and their actuators in their extended, operative positions and with the movable stop members in their inoperative positions, and the elevator in its lowermost limit position atop the safety columns.

FIG. 3 is a perspective view of the conventional elevator and the elevator safety system of FIG. 1, with the components of the elevator safety system in their inoperative positions and the elevator in its normal operating position with the lowest floor landing.

FIG. 10 shows the arrangement of FIGS. 10A, 10B, and 10C, which together form a relay logic diagram of an elevator control circuit that incorporates the elevator safety system according to the present invention, wherein:

FIG. 10A shows a first section of the circuit that embodies the control circuit for the elevator safety system;

FIG. 10B is a relay logic diagram of a second section of the control circuit for a conventional elevator system operating in conjunction with the elevator safety system of FIG. 10A.

DETAILED DESCRIPTION OF THE PREFERRED EMBODIMENTS

Figure 1:
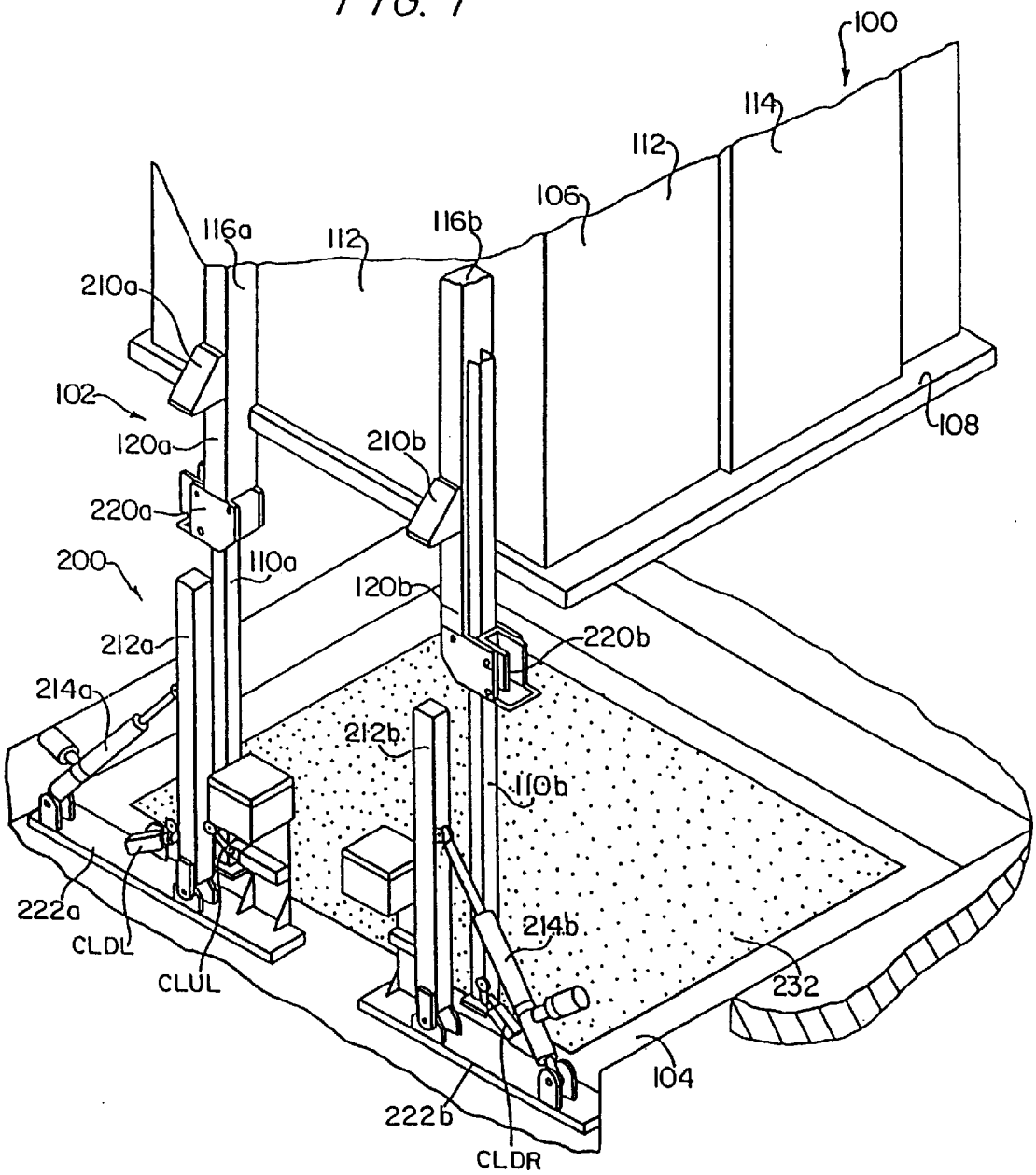
FIG. 1 is a perspective view of a conventional elevator incorporating an elevator safety system in accordance with the present invention, with the safety columns and their actuators in their extended, operative positions to create a false safety pit below the elevator car floor.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring now to FIG. 1, there is shown a conventional elevator 100 in which an elevator safety system 200 in accordance with the present invention is installed. By a conventional elevator is meant a hoistway 102 having at its bottom a pit floor 104, a car 106 positioned above the pit floor 104, and a pair of rails 110*a* and 110*b* for guiding vertical travel of the car 106. The car 106 includes a car floor 108, four car side walls 112, a door 114 in one of side walls 112, and a frame affixed to one of the other side walls 112. Typically, the frame comprises a pair of vertical stiles 116*a* and 116*b* having lower ends 120*a* and 120*b* extending below the car floor 110, which vertical stiles 116*a* and 116*b* are positioned inwardly of the rails 110*a* and 110*b*.

The elevator safety system in accordance with the present invention comprises a combination of mechanical, electromechanical, and electrical components which are activated by or in response to actions of the elevator maintenance worker or movement of the car 106, or which interact with the components of the conventional elevator. As shown in FIGS. 1–9, the mechanical and electromechanical components which interact with the components of the elevator include left and right laterally-spaced, fixed stop members 210*a* and 210*b* fixedly attached to left and right stiles 116*a* and 116*b* above their lower ends 120*a* and 120*b*, left and right laterally-spaced safety columns 212*a* and 212*b*, left and right actuators 214*a* and 214*b* operatively connected to left and right safety columns 212*a* and 212*b*, respectively, and left and right laterally-spaced, movable stop members 220*a* and 220*b* movably attached to the left and right rails 110*a* and 110*b*, respectively. The safety columns 212*a* and 212*b* and their associated components are the mirror images of each other.

Safety columns 212*a* and 212*b* are pivotable between an extended position (see FIGS. 1, 2, 4, and 5) in vertical alignment with left and right fixed stop members 210*a* and 210*b*, respectively, and a retracted position (see FIGS. 3 and 6) clear of the car 106, the frame, the rails 110*a* and 110*b*, and the left and right fixed stop members 210*a* and 210*b*. Left and right actuators 214*a* and 214*b* preferably comprise pistons which pivot left and right safety columns 212*a* and 212*b* between their extended and retracted positions. These pistons can be electro-mechanical. Also as shown, safety columns 212*a* and 212*b* and left and right actuators 214*a* and 214*b* can be mounted on left and right plates 222*a* and 222*b*, respectively, which plates are affixed to pit floor 104.

Figure 4:
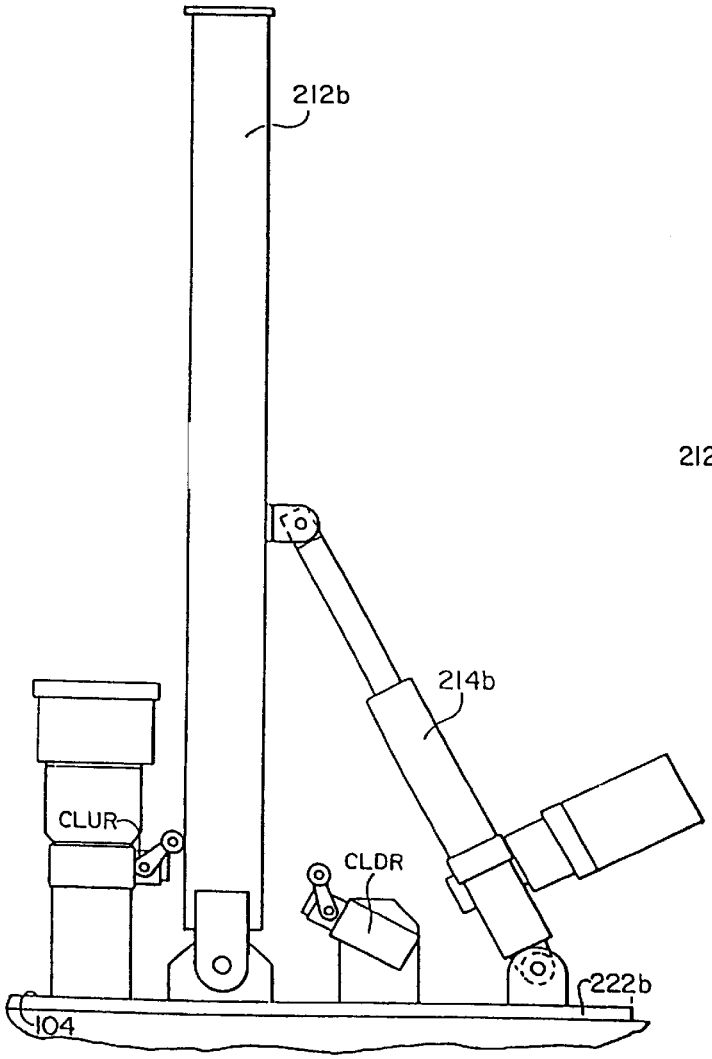
FIG. 4 is an elevational view of a safety column, its actuator and its limit switches in accordance with the present invention.

FIGS. 1–6 illustrate the locations of left and right column "up" limit switches CLUL and CLUR and left column "down" limit switches CLDL and DLDR, it being understood that right column "up" limit switch CLUR and right column "down" limit switch CLDR as shown in FIG. 4 are the mirror images of left column "up" limit switch CLUL and left column "down" limit switch CLDL relative to their respective safety columns 212*b* and 212*a* and their respective actuators 214*b* and 214*a*. As will be explained further below, the limit switches CLUL, CLUR, CLDL and CLDR are used to generate signals for controlling the operation of the elevator safety system of the present invention. When the safety column 212*a* or 212*b* is in the fully extended position, it contacts the corresponding column "up" limit switch CLUL or CLUR; when in the fully retracted position, the safety column 212*a* or 212*b* contacts the corresponding column "down" limit switch CLDL or CLDR.

Referring again to FIGS. 1–3, left and right movable stop members 220*a* and 220*b* are movable between a first position in vertical alignment with left and right stiles 116*a* and 116*b* and a second position clear of left and right stiles 116*a* and 116*b*. As shown in FIG. 1, when the left and right movable stop members 220*a* and 220*b* are in the first position, the left and right stiles 116*a* and 116*b* can rest on the left and right movable stop members 220*a* and 220*b* when the elevator car 106 is lowered onto them. This allows for access underneath the elevator car 106. As shown in FIG. 3, when the left and right movable stop members 220*a* and 220*b* are in the second position clear of the left and right stiles 116*a* and 116*b*, and the safety columns 212*a* and 212*b* are in their retracted positions, the elevator car 106 can be lowered down to its position for normal operation with the lowest level (i.e., the first floor). As shown in FIG. 2, when the left and right movable stop members 220*a* and 220*b* are in the second position clear of the left and right stiles 116*a* and 116*b*, and the safety columns 212*a* and 212*b* are in their extended positions, the elevator car 106 can be lowered down to its lowest safety limit atop the safety columns 212*a* and 212*b*, creating the minimum under-car clearance (false pit) underneath the elevator car 106.

Figure 7A:
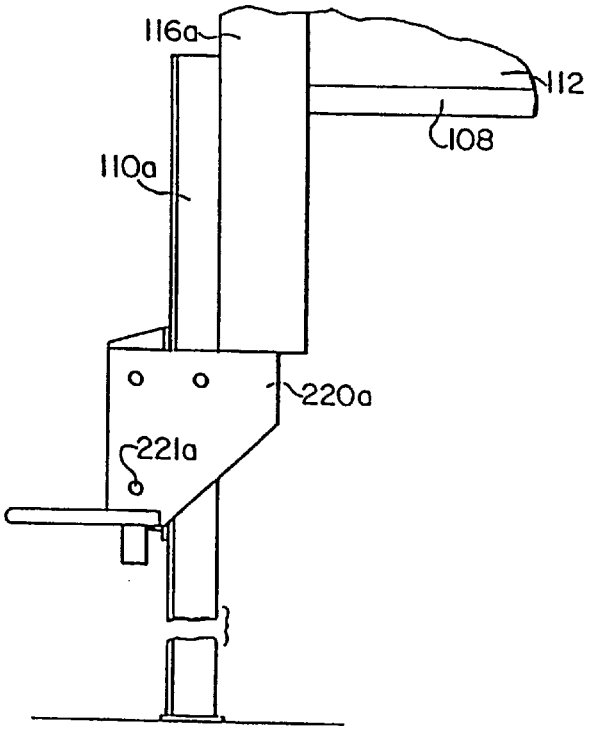
FIGS. 7A and 7B are elevational views illustrating the operative and inoperative positions, respectively, of one of the rail safety arms in accordance with the present invention.
Figure 7B:
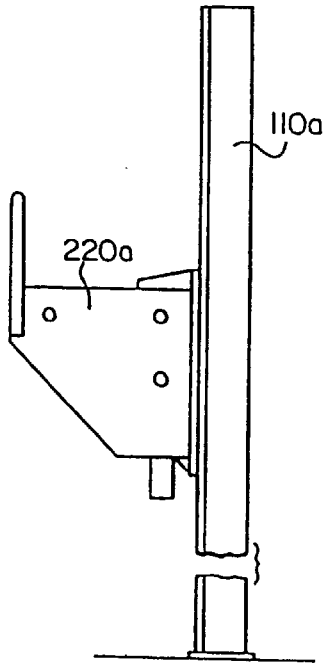
Figure 8A:
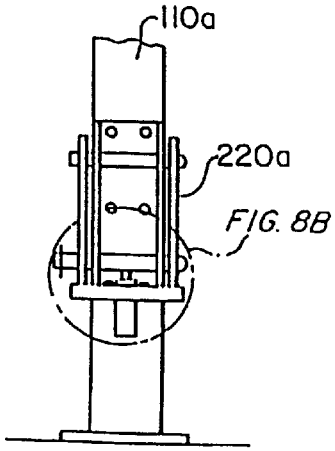
FIGS. 8A and 8B are an elevational view and a magnified view, respectively, of the movable stop member, illustrating the safety arm limit switch according to the present invention.
Figure 8B:
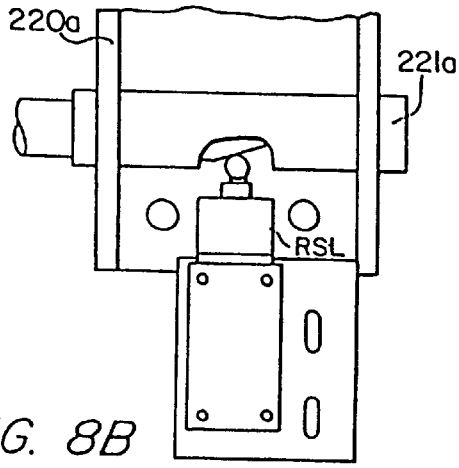

The first or operative position of the movable stop member 220*a* relative to rail 110*a* is further illustrated in FIG. 7A, and the second or inoperative position of the movable stop member 220*a* relative to rail 110*a* is further illustrated in FIG. 7B, it being understood that the first and second positions of the movable stop member 220*b* relative to rail 110*b* are the mirror images thereof. As shown in FIG. 7A, the left stop member 220*a* can be secured in the first or operative position using lock pin 221*a*, the right stop member 220*b* similarly being secured in the first or operative position using a lock pin 221*b*. As shown in FIGS. 8A and 8B, when the lock pin 221*a* is in place in left movable stop member 220*a*, it interconnects with a corresponding rail safety limit switch RSL mounted on rail 110*a*. Similarly, when the lock pin 221*b* is in place in right movable stop member 220*b*, it interconnects with a corresponding rail safety limit switch RSR mounted on rail 110*b*.

A conventional key-operated inspection switch 122 (see FIG. 10B) is located inside the car 106, typically next to the elevator door 114, while conventional key-operated access switches 124*a* and 124*b* (see FIG. 10B) are located at the topmost and bottommost landings, respectively. Inspection switch 122 disables the normal elevator control (that is, the normal elevator call station devices), so that car 106 will not respond to a call from an elevator user while the elevator is being serviced. Access switches 124*a* or 124*b* are used by the elevator technician to move car 106 up or down a limited distance, typically five (5) to six (6) feet. They are enabled by inspection switch 122 and are key-controlled by constant pressure; that is, access switches 124*a* and 124*b* will not function unless inspection switch 122 has first been turned on, and then will not function unless constant pressure is exerted.

For a car 106 at the lowest landing level, the key-operated inspection switch 122 in the operation panel inside the car 106 must be turned on to disable all other devices that would cause the car 106 to move away from the lower landing. The keyed inspection switch 122 also maintains the power-operated car 106 and landing doors in the open position and enables the key-operated bottom access switches 124*b* located, for example, on a panel in the car 106 that is accessible only to building security or maintenance personnel. Once the technician activates the inspection switch, he can hold the access switch in the "up" position to move the car 106 upwards and bring the pit floor 104 into view.

Figure 9:
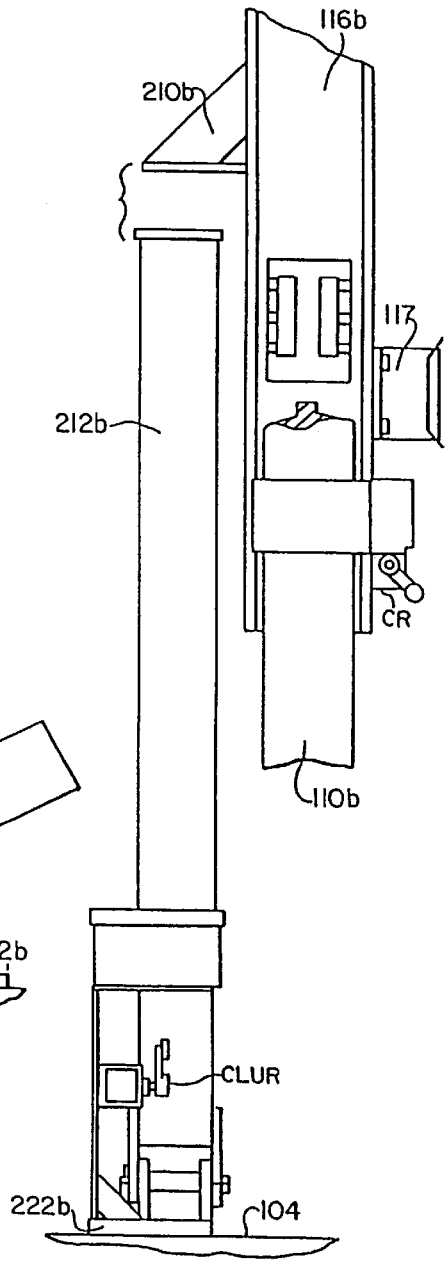
FIG. 9 is a partial elevational view of the elevator and the elevator safety system illustrating the structure of the column enable limit switch.
Figure 5:
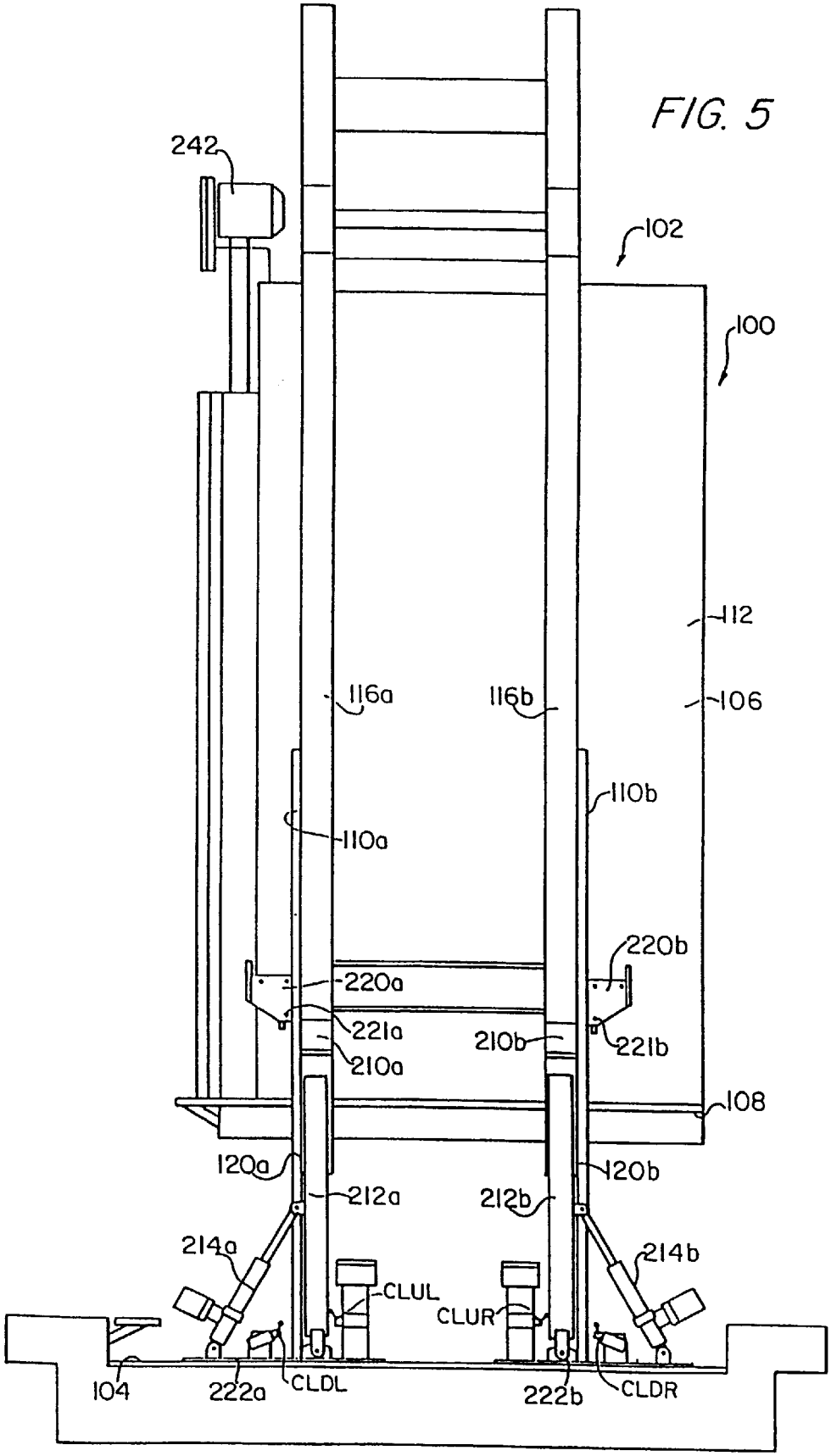
FIG. 5 is an elevational view of the conventional elevator and the elevator safety system of FIG. 1, with the safety columns and their actuators in their extended, operative positions and the limit switches in their positions as determined by the operative position of the safety columns.
Figure 6:
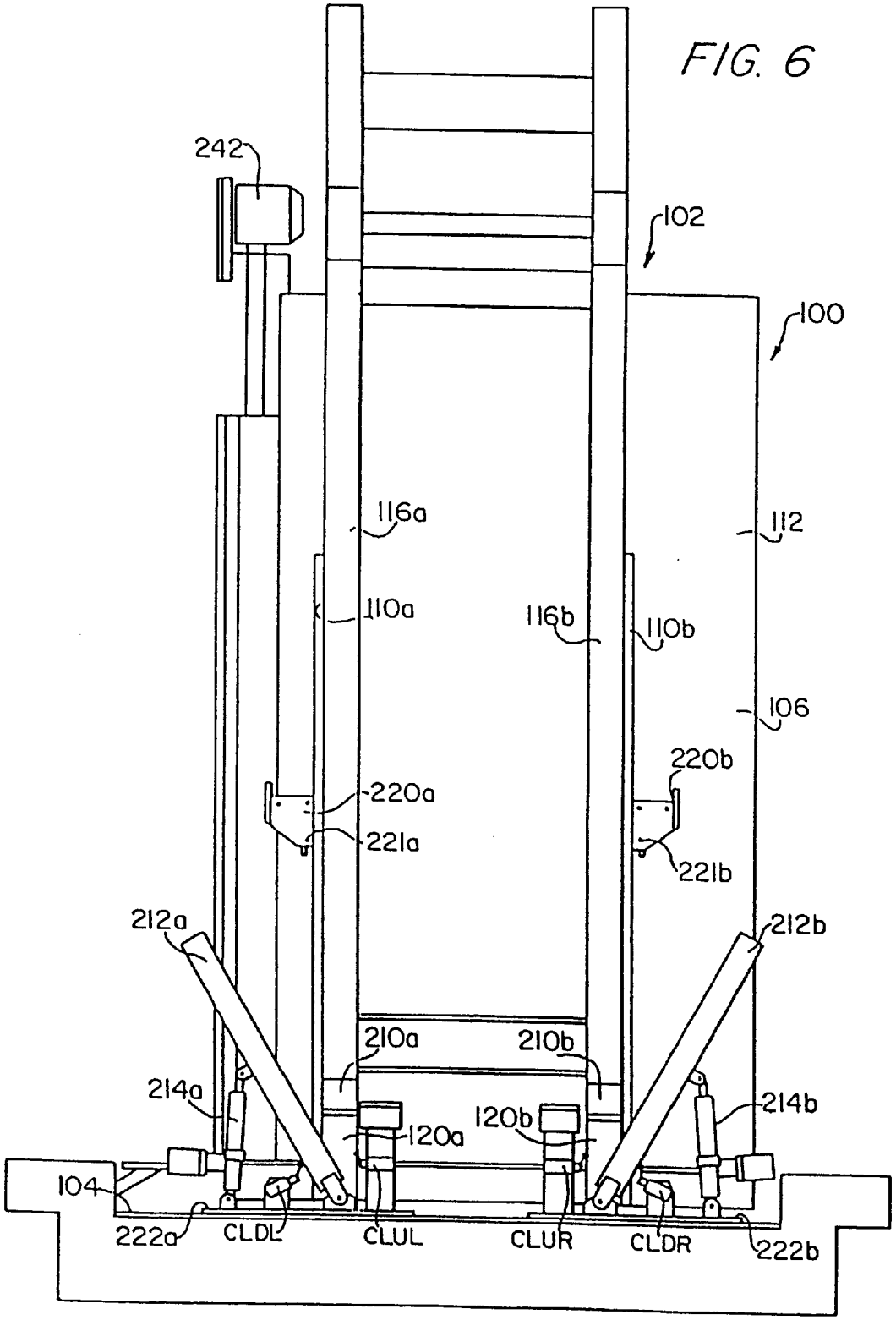
FIG. 6 is an elevational view of the conventional elevator and the elevator safety system of FIG. 1, with the components of the elevator safety system in their inoperative positions and the limit switches in their positions as determined by the inoperative position of the safety column.

In order to prevent left and right actuators 214*a* and 214*b* from moving left and right safety columns 212*a* and 212*b* into their extended positions without sufficient clearance under movable stop members 220*a* and 220*b*, means such as a column enable limit switch CL is mounted on rail 110*a* or 110*b* and operated by a cam fixed to the elevator frame for enabling operation of actuators 214*a* and 214*b* (see FIG. 9, which illustrates safety column 212*a* and associated components, it being understood that safety column 212*b* and associated components would appear as the mirror image thereof). The limit switch CL is positioned so that it will be activated by the elevator car 106 when car 106 has travelled high enough so that safety columns 212*a* and 212*b* can pivot into their extended position without interference from movable stop members 220*a* and 220*b*. For example, as shown in FIG. 9, switch cams 117 are fixedly connected to the elevator car 106 (e.g., along the stiles 116*a* and 116*b*) whereby the elevator car 106 travelling up at least a minimum distance (e.g., 30 inches) will cause the switch cam 117 to contact and energize the limit switch CL. Once actuators 214*a* and 214*b* have been activated, they will continue to move from their retracted to their extended positions until they reach their extended positions. While actuators 214*a* and 214*b* are extending, car 106 can only travel in the "up" direction; it is electrically prevented from travelling in the "down" direction.

Preferably, the limit switch CL is activated, and activation of safety columns 212*a* and 212*b* take place, before car 106 has traveled more than the minimum distance established by the position of the switch cam 117 (i.e., 30 inches) above the pit floor 104; and safety columns 212*a* and 212*b* are in their extended positions before car 106 has traveled a nominal distance (e.g., 36 inches) above the pit floor 104. In other words, safety columns 212*a* and 212*b* preferably can move from their retracted to their extended positions in the time it takes car 106 to travel upwardly a minimum distance, i.e. not more than six (6) inches.

A pressure-activated switch 230 (see FIG. 10A) located, for example, in a safety floor mat 232, is positioned on the pit floor 104 and is electrically connected to the actuators 214*a* and 214*b* for setting the safety columns 212*a* and 212*b* in place. In addition, the pressure-activated switch 230 is connected to the power circuits for the hoist motor 242 of the elevator car 106. A minimum weight, for example five pounds, applied to the surface of mat 232 activates the actuators 214*a* and 214*b* to set the safety columns 212*a* and 212*b* in place, and prevents the hoist motor 242 of the elevator car 106 from responding to the access switch 124. Removal of the weight from the mat surface re-enables control of the hoist motor 242 by the access switch 124.

Figures 10, 10A, 10B, 10C:
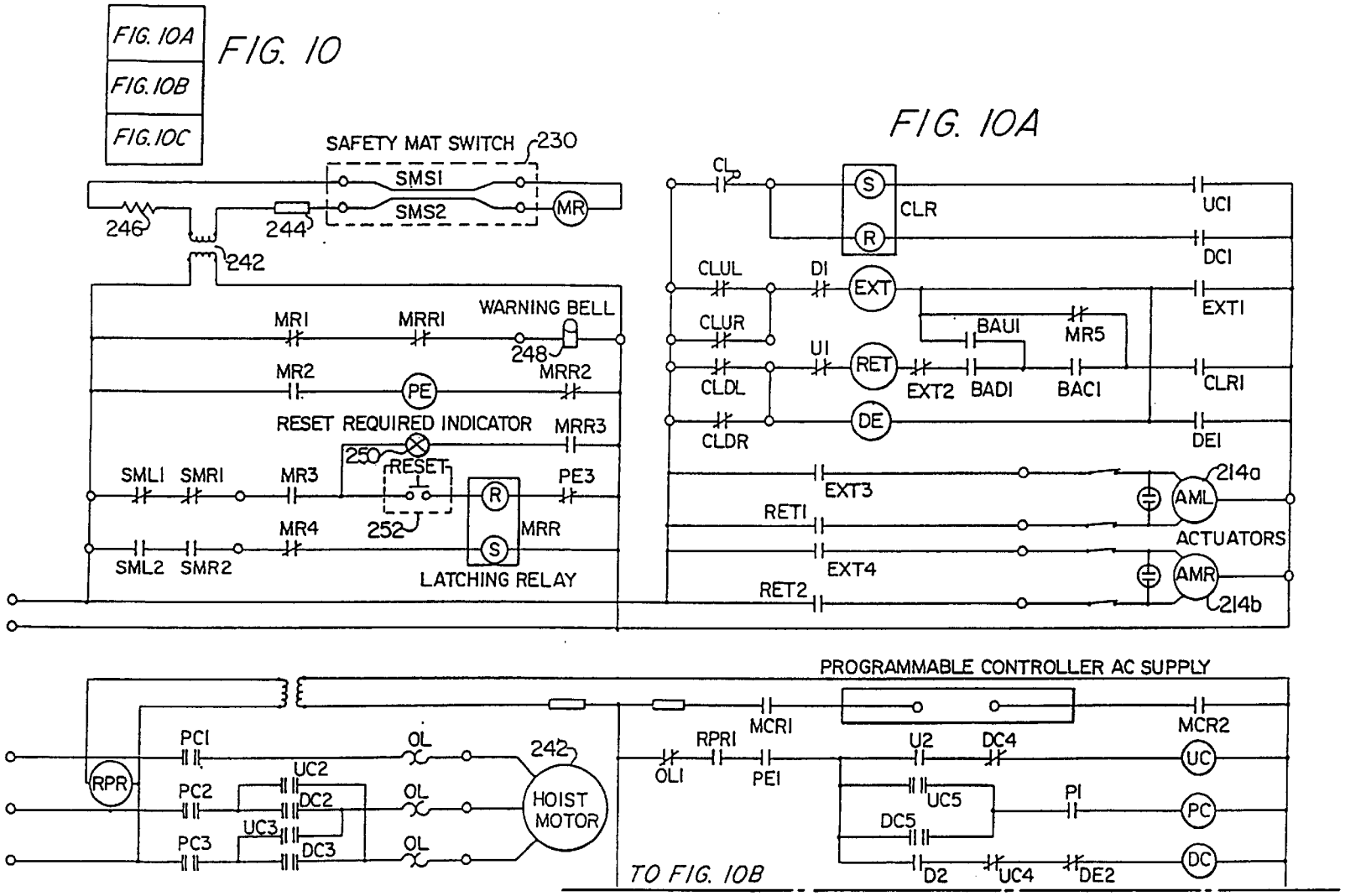
Figure 10C:
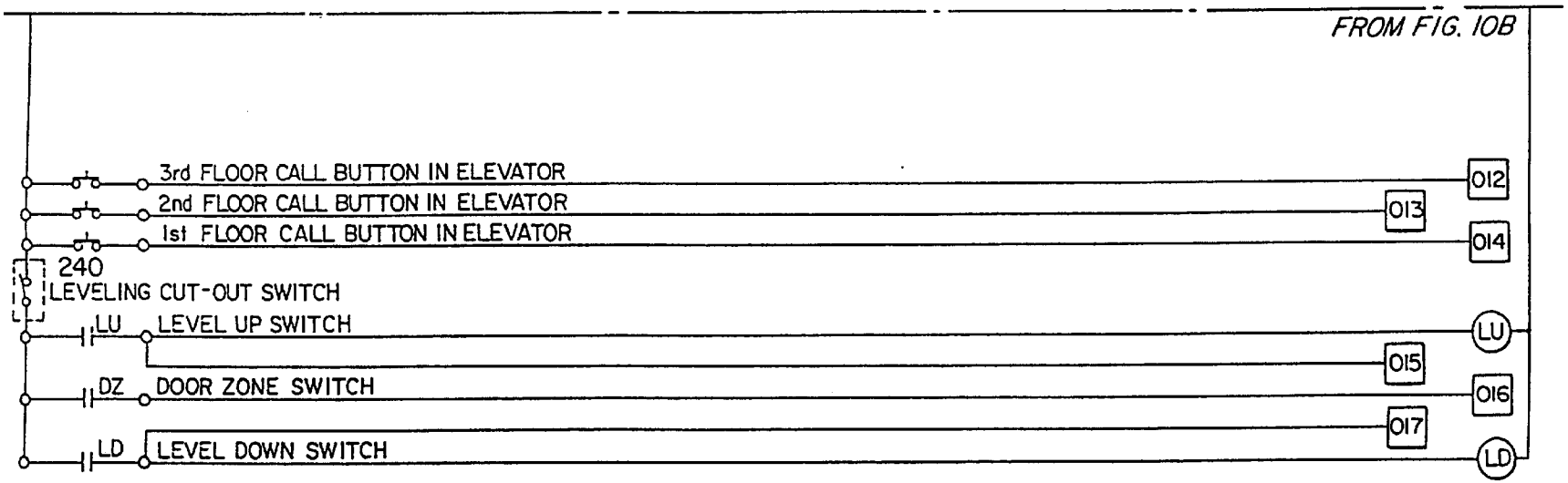
FIG. 10C is a relay logic diagram of a third section of the control circuit for a conventional elevator system operating in conjunction with the elevator safety system of FIG. 10A.

One example of a control circuit for controlling the above-described operation is illustrated in FIGS. 10A–10C. As is known in the art, programmable controllers can be used to implement the control system of a conventional elevator system. The control circuit of the present invention can be incorporated into the control system of a conventional elevator system, and can be implemented by using, for example, a programmable controller such as an Allen-Bradley Model SLC-500 controller. In the case of such an example, the implementation of the control circuit for the present invention is represented in a relay logic ladder diagram applicable either to a programmable controller or to a hard-wired circuit. FIG. 10A shows the relay logic connections that make up the main elements of the control circuit for the elevator safety system. FIGS. 10B and 10C show the relay logic connections for elements that embody a conventional elevator control system and that operate in conjunction with the elevator safety system.

As is known in the art, relay logic ladder diagrams illustrate the connections between the relays (via relay contacts and relay coils), limit switches, control switches, and other elements that together control the operation of a system. Essentially, each line in the ladder diagram illustrates the various contacts and switches that represent the conditions that will turn ON or OFF the relay coil in that line. In other words, the energizing or de-energizing of the relay coil in each line is based on satisfying the conditions represented by each contact or switch in the line. The relay coil in each line represents either the operation of an actual physical component (i.e., a motor) or the satisfying of a combination of conditions as represented by the contacts and/or switches in the line (i.e., the access space underneath the elevator is unoccupied, allowing the normal operation of the elevator). The operations of the relay coils are in turn translated into relay contacts in other lines that are needed to satisfy the conditions for the operation of the relay coils in those other lines.

As will be explained hereinafter, the relay contacts of some specific relay coils in the control circuit of the present invention will be used in several places to determine the conditions of numerous other relay coils, i.e. the relay contact for the Safety Mat Relay Coil MR is used as one of the conditions for operating other devices including the RESET armature of the Safety Mat Circuit Reset latching relay MRR, a Reset Required indicator, and the Power Enable relay coil PE. For purposes of referencing such different applications of the same relay contact, each application will be assigned a separate alphanumeric reference symbol (e.g., MR1, MR2, MR3).

The relays of a programmable controller, through their corresponding relay coils and relay contacts, are used to interface the outputs of the programmable controller's logical operations with high amperage operating devices, such as motor contactors, or where relay logic provides a more flexible wiring arrangement than conventional hardwired relay logic circuits.

When incorporating the control circuit of the present invention into the control circuit of a conventional elevator system, some relays in the conventional system will be duplicated in the control circuit of the present invention in order to accommodate the interfacing of the control circuit with the conventional system. For example, the "up" direction of travel relay coil U and the "down" direction of travel relay coil D, both of which will be described below, can be duplicated in the control circuit of the present invention. Further, relays for functions that are not available in some conventional elevator systems will be provided by the control circuit of the present invention, also in order to accommodate the interfacing of the present invention with the conventional elevator system. An example of a function implemented in relays that would be provided is allowing inspection access when the elevator car is located at the lowest landing level.

As shown in the control circuit of FIG. 4, a car clear latching relay CLR incorporates a SET relay armature S and a RESET relay armature R. The SET relay armature S is energized when a column enable limit switch CL and an "up" contactor relay contact UC1 are set. The column enable limit switch signals that the elevator car 106 is above the height of the safety columns 212*a*, 212*b*. The "up" contactor relay contact UC1 signals that the "up" contactor relay coil UC is energized. The "up" contactor relay coil UC is used to apply voltage to the hoist motor 242 of the elevator car 106 for upward movement. If the elevator car 106 is not above the height of the safety columns 212*a*, 212*b*, and/or if the "up" contactor relay coil UC was not energized, then the SET relay armature S does not energize.

Similarly, the RESET relay armature R is energized when the column enable limit switch CL and a "down" contactor relay contact DC1 are set. The "down" contactor relay contact DC1 signals that the "down" contactor relay coil DC is energized. The "down" contactor relay DC is used to apply voltage to the hoist motor 242 of the elevator car 106 for downward movement. If the elevator car 106 is not above the height of the safety columns 212*a*, 212*b*, and/or if the "down" contactor relay coil DC is not energized, then the RESET relay armature R does not energize. By using the car clear latching relay CLR, only the RESET relay armature R or the SET relay armature S is energized at any one time. The energizing of one relay armature automatically de-energizes the other relay armature.

As indicated above, the safety mat 232 in the pit floor 104 of the hoistway 102 incorporates a safety mat switch 230. This safety switch 230 has two switch surfaces SMS1, SMS2 connected in series with and one on each side of the safety mat switch relay coil MR. When no weight is on the safety mat 232, the safety mat relay coil MR is energized. When a weight falls on the safety mat 232, the two switch surfaces SMS1, SMS2 contact with each other, thereby short-circuiting and de-energizing the safety mat relay coil MR.

The safety column extend relay coil EXT is energized through the latching relay contact CLR1, the normally-closed safety mat switch relay contact MR5, and the normally-closed "down" relay contact D1, respectively. Alternatively, the safety column extend relay coil EXT can be energized through the latching relay contact CLR1 (when the SET armature is energized), the bottom access-up relay coil BAU1, bottom access-common relay coil BAC1, and the normally-closed "down" direction of travel relay contact D1. Further, the safety column extend relay coil EXT can be energized through the energizing of the "down" enable relay coil DE through its "down" enable relay contact DE1, as will be explained below. Once the safety column extend relay coil EXT is energized, the safety column extend operation relay contact EXT1 activates maintaining the energized state of the safety column extend relay coil EXT.

As described above, each of the safety columns 212*a*, 212*b* includes a normally-closed column "up" limit switch CLUL or CLUR. These limit switches also control the energizing of the safety column extend relay coil EXT through their corresponding normally-closed left and right column "up" limit switch contacts. While the safety columns are retracted, the limit switches CLUL, CLUR are not set, thereby maintaining the contacts of the column "up" limit switches CLUL, CLUR in their normally-closed positions. This allows the safety column extend relay coil EXT to energize through the operation of other above-described relay contacts. When the safety columns 212*a*, 212*b* reach their fully-extended positions, the limit switches CLUL, CLUR are set, which then deactivates their contacts, and de-energizes the relay coil EXT leaving the safety columns 212*a*, 212*b* in their fully-extended positions.

The safety column retract relay coil RET is energized through bottom access-common relay contact BAC1, the bottom access-down relay contact BAD1, the latching relay device CLR1 (when the SET relay armature S energized), the normally-closed safety column extend relay contact EXT2, and the normally-closed "up" relay contact U1.

Each of the safety columns 212*a*, 212*b* also includes a normally-closed column "down" limit switch CLDL or CLDR. The normally-closed column "down" limit switches CLDL, CLDR control the energizing of the safety column retract relay coil RET. While the safety columns are extended, these limit switches are not set, thereby maintaining the contacts of the column "down" limit switches CLDL, CLDR in their normally-closed positions. When the safety columns reach their fully-retracted positions, the contacts of the column "down" limit switches CLDL, CLDR are deactivated, which then de-energizes the safety column retract operation relay coil RET.

The "down" enable relay coil DE is initially energized through the safety column extend relay contact EXT1. Once the "down" enable relay coil DE energizes, the "down" enable relay contact DE1 also energizes, thereby maintaining the energized state of the relay coil DE should the safety column extend operation contact EXT1 de-energize. Like the safety column retract operation relay coil RET, the setting of the column "down" limit switches CLDL, CLDR de-energizes the "down" enable relay coil DE.

To physically extend or retract the safety columns 212*a*, 212*b*, the left and right actuators 214*a*, 214*b* connected respectively to the safety columns 212*a*, 212*b* are controlled by the operation of the safety column extend relay coil EXT and the safety column retract relay coil RET. Specifically, when the safety columns 212*a*, 212*b* are to be extended, the safety column extend relay contacts EXT3 and EXT4 are activated by the energizing the safety column extend relay coil EXT. When the safety columns 212*a*, 212*b* are to be retracted, the safety column retract relay contacts RET1 and RET2 are activated by energizing the safety column retract relay coil RET. As shown in FIG. 4, the safety column extend relay contacts EXT3 and EXT4 are connected on poles opposite the safety column retract relay contacts RET1 and RET2, respectively. In operation, the safety column extend operation relay contacts EXT3 and EXT4 activate their corresponding actuator motors AML, AMR to extend the safety columns 212*a*, 212*b*. Correspondingly, the safety retract operation relay contacts RET1 and RET2 energize the corresponding actuator motors AML, AMR to retract the safety columns 212*a*, 212*b*.

In the safety mat circuit reset latching relay MRR, the SET relay armature S is energized by the placement of the movable stop members 220*a*, 220*b*. The positions of the movable stop members 220*a*, 220*b* are indicated by rail safety arm limit switches RSL, RSR. As discussed above, FIGS. 1–3 illustrate the locations of the rail safety arm limit switches RSL, RSR relative to the movable stop member 220*a* or 220*b* and the rail 101*a* or 110*b*. The positions of the movable stop members are indicated by the rail safety arm limit switch contacts SML2 for the left movable stop member and SMR2 for the right movable stop member. In addition to the rail safety arm limit switch contacts SML2, SMR2 of the rail safety arm limit switches RSL and RSR, the SET relay armature S for the safety mat circuit reset latching relay MRR is energized through a normally closed safety mat switch relay contact MR4 of the safety mat switch relay coil MR.

The RESET relay armature R of the safety mat circuit reset latching relay MRR is energized when the left and right movable stop members 220*a*, 220*b* are not positioned to catch the elevator car 106 (i.e., when they are clear of the elevator car 106). For the RESET relay armature R, the positions of the movable stop members are indicated by normally closed rail safety arm limit switch contacts SML1 for the left movable stop member 220*a* and SMR1 for the right movable stop member. 220*b* in addition, the RESET relay armature R is energized through a safety mat switch relay contact MR3 of the safety mat switch relay coil MR, and a normally closed the power enable relay contact PE3 of a power enable relay coil PE. Finally, activation of the RESET relay armature R is completed through the use of a momentary contact switch/button RESET. Since the safety mat circuit reset latching relay MRR is a latching relay, energizing the RESET relay armature R automatically de-energizes the SET relay armature S.

The power enable relay coil PE controls the application of AC voltage to the circuits of the elevator system. It is energized through a safety mat switch relay contact MR2 and a normally closed safety mat circuit reset latching relay contact MRR2. In other words, the power enable relay coil PE is energized as long as no weight is placed on the safety mat 230 (i.e., the safety mat relay coil is energized), and the left and right movable stop members 220*a*, 220*b* are not positioned to catch the elevator car 106 (i.e., the safety mat circuit reset latching relay MRR is reset ).

A Reset Required indicator (e.g., an indicator light) is energized through the normally closed left rail safety arm limit switch contact SML1, the normally closed right movable stop member limit switch contact SMR1, the safety mat switch relay contact MR3, and the safety mat circuit reset latching relay contact MRR3.

An audible warning alarm (e.g., a warning bell, horn, or beeper) is used to indicate that the movable stop members 220*a*, 220*b* should be placed into position and that lock pins 221*a*, 221*b* should respectively be installed to lock the movable stop members 220*a*, 220*b* in place. The warning signal is energized through the safety mat switch relay contact MR1 and the safety mat circuit reset latching relay contact MRR1.

Power for the motive source for moving the safety columns 212*a*, 212*b* in and out of position (e.g., an electric motor, an electric solenoid, or an electromechanically-controlled pneumatic cylinder) is controlled by the operation of the "up" contactor relay coil UC, the "down" contactor relay coil DC, and the potential contactor relay coil PC. Specifically, the "up" contactor relay coil UC applies voltage to the motive source for upward travel of the elevator cars. The "down" contactor relay coil DC applies voltage to the motive source for downward travel of the elevator cars. The potential contactor relay coil PC applies voltage to the "up" and "down" contactors UC, DC.

As shown in FIG. 10A, the relay circuit structure for energizing the "up" contactor relay coil UC, the "down" contactor relay coil, and the potential contact relay coil PC is consistent with elevator control circuits as known in the art. However, in addition to the normally-closed overload relay contact OL1 and the reverse phase relay contact RPR1 controlling the energizing of all three relay coils UC, PC and DC, a power enable relay contact PE1 is included. As a result, the three relay coils UC, PC and DC can only be energized when the power enable relay coil PE is energized. As noted above, the power enable relay coil PE is energized as long as no weight is placed on the safety mat 230 (i.e., the safety mat relay coil is energized), and the left and right movable stop members 220*a*, 220*b* are not positioned to catch the elevator car 106 (i.e., the safety mat circuit reset latching relay MRR is reset). Further, in the circuit structure for energizing the "down" contactor relay coil DC, a normally closed "down" enable relay contact DE2 is included to prevent the downward travel of the elevator. Specifically, when the safety columns 214*a*, 214*b* are fully retracted and the normally closed safety column limit switches CLDL, CLDR are open, the "down" enable relay coil DE is de-energized as indicated by the energizing of the safety position relay coil DE, the normally closed safety column position relay contact DE2 maintains the "down" contactor relay coil DC useable.

As shown in FIG. 10B, the keyed inspection switch 122 (KIS) is a normally-closed switch that controls a primary inspection relay coil IN. The access switch 124 is connected to be active when the keyed inspection switch 122 (KIS) is opened. The opening of the keyed inspection switch 122 (KIS) de-energizes the primary inspection relay coil IN thereby allowing the access switch 124 to selectively energize either the bottom access, "up" relay coil BAU or the bottom access, "down" relay coil BAD, while activating the bottom access, common relay coil BAC. Selectively energizing the bottom access, "up" relay coil BAU or the bottom access, "down" relay coil BAD will in turn control the up or down movement of the elevator car 106 in the process of accessing the pit floor 104 in the hoistway 102.

In FIG. 10B, the "down" relay coil D and the "up" direction of travel relay coil U provide travel direction control and interfacing of circuits related to controlling movement of the elevator car 106 in the respective directions. The potential relay coil P and its corresponding relay contacts potential contactor control. The devices and operations which together control the energizing/de-energizing of the "down" relay coil D, the "up" relay coil U, and the potential relay coil P are consistent with those devices and operations which are incorporated in conventional elevator systems using programmable controllers. Such devices include, as shown in FIG. 10B, the door interlock relay coil DIL and its corresponding contacts for monitoring the opening and closing of the elevator doors and the elevator car gate. A secondary inspection relay coil INT and its corresponding contacts interface the top and bottom floor access controls with the control elements of the "up" relay coil U, the "down" relay coil D, and the potential relay coil P.

The "down" relay coil D and the "up" relay coil U are selectively energized or de-energized as a result of the operation of the access switches 124*a* or 124*b*. Specifically, the access switch 124*a*, as discussed above, controls the operation of the top access, "up" relay coil TAU or the top access, "down" relay coil TAD, along with the top access, common relay coil TAC. As the top access relay coils are selectively operated in order to move the elevator car up or down with the access switch 124*a*, corresponding top access relay contacts are activated or deactivated. Further, the access switch 124*b* controls the operation of the bottom access, "up" relay coil BAU or the bottom access, "down" relay coil BAD, along with the bottom access, common relay coil BAC. As the top and bottom access relay coils are selectively operated in order to move the elevator car up or down with the access switches 124*a* or 124*b*, corresponding top or bottom access relay contacts are activated or deactivated. Activation of these access relay contacts as illustrated in FIG. 10B, when in combination with other control elements as illustrated, will then selectively energize or de-energize the "down" relay coil D and the "up" relay coil U. The master control relay MCR controls the application of power to the programmable controller.

As shown in FIG. 10C, the level "up" relay coil LU and the level "down" relay coil LD, and their corresponding relay contacts control car re-leveling and, to a limited extent, deceleration in their corresponding directions.

Other elements shown in the relay logic ladder diagrams of FIGS. 10A–10C which have not been described in detail comprise devices and operations that are found in conventional elevator systems and therefore would be known to one of ordinary skill in the art.

As an example of the operation of the present invention, the following discussion sets out the operation of the elevator control circuit shown in FIGS. 10A–10C. For illustrative purposes only, FIGS. 10A–10C incorporate circuitry for operating an elevator control system in a building with three floors or landings. However, the present invention in all its embodiments and equivalents can be applied to elevator systems in buildings with more, or even fewer (e.g., two) floors or landings.

As one of ordinary skill in the art would understand, when AC power is applied to the entire elevator system, the elevator becomes available for normal service. As part of the elevator system's normal operation, some relays will be energized, and some switches will be in an operating state depending on the location of the elevator car 106. Certain relays will be energized no matter at which floor the elevator car 106 is parked. For purposes of this example, the sequence of operation will begin with the assumption that the elevator car 106 will begin at the third floor and travel to the first floor (lowest landing). Further, all safety devices are initially in the non-operated condition. Further, the elevator car gate and all landing doors are assumed to be closed, thereby closing all of the normally open gate and door contacts of their respective switches.

Depending on the start-up situation, programmable controller inputs 008, 010 and 016 as shown in FIGS. 10B and 10C will be energized. The following relay coils as previously described above will be energized: RPR, MR, PE, MCR, DIL, IN, and INT. When the reverse phase relay coil RPR is energized, its relay contact RPR1 is closed. The normally-closed relay contact MR1 is open, while the safety mat relay coil MR is energized. The nornally-closed safety mat circuit latching relay contact MRR2 closes when the RESET armature R of the safety mat circuit latching relay MRR energizes. The relay contacts MR2 and MRR2 allow power enable relay coil PE to energize. The relay contact MR3 will close, while the normally-closed relay contact MR4 will open. The normally-closed relay contacts MRR1 and MRR2 will be closed, while the relay contact MRR3 is open. The normally-closed relay contact PE3 is open. The normally-closed relay contact MRS will be open. The power enable relay contacts PE1, PE2 and PE4 are closed. Latching relay contact CLR1 will be closed while the elevator car 106 is located above the column enable limit switch CL. When the elevator car 106 travels to the second floor or third floor landing from the first floor landing, the "up" contactor relay contact UC1 closes. As the elevator car 106 goes past the column enable limit switch CL, the SET armature of the car clear latching relay CLR is energized, thus closing relay contact CLR1. At this point, the safety columns 212*a* and 212*b* can be electrically operated, whereby the actuators will extend to reposition the safety columns 212*a* and 212*b* into their vertical positions beneath the elevator frame.

While all major safety switches remain closed, the master control relay MCR is energized. Relay contacts MCR1 and MCR2 are closed, thereby applying AC power to the programmable controller of the elevator system. As long as the PE2 and PE4 relay contacts remain closed, and the In Car Stop Switch, the car gate, and all doors remain closed, the door interlock relay coil DIL is energized and its relay contact DIL1 is closed.

While the Controller Inspect Switch 234 and the Keyed Inspect Switch 122 in the elevator remain closed, primary inspection control relay coil IN will be energized. Its relay contacts IN3 will be closed, while the normally-closed relay contact IN2 will be open. INT will be energized, while the Car Top Inspect Switch 236 is closed. The relay contact INT2 secondary inspection control relay coil will be closed. The Hall Button Cut-Out Switch 238 is closed. The Leveling Cut-Out Switch 240 is also closed. Normally-closed relay contacts INT1 and IN1 will both be open. The 3rd Floor Zone Switch Z3 will be closed by the switch cams 117 attached to the elevator frame. The Door Zone Switch DZ will also be closed, but by a different cam or vane located at the landing. Each landing is equipped with an identical switch operator because the Door Zone Switch DZ is attached to the elevator. The Door Zone Switch DZ is required for power operated doors but still serves a purpose when manually operated gates are used.

Momentarily pressing the Hall Call Button, an input signal is sent to the programmable controller at Input 004. After the signal is processed, the programmable controller will produce a signal at Output 003. This signal is routed through the normally closed contact of the Normal "Down" Limit Switch. The signal then returns to the elevator controller where it passes through a normally-closed "up" relay contact U4. From this point the signal becomes an input to the programmable controller at Input 007. At the same time, the "down" relay coil D is energized. After the "down" relay coil D has energized, its relay contact D4 closes, allowing the same output signal to pass through the closed relay contact DIL1 of the energized door interlock limit relay coil DIL to energize the potential relay coil P. At the same time, the output signal becomes an input to the programmable controller at Input 006. The normally-closed "down" relay contact D3 is open, ensuring that the "up" relay coil U cannot energize.

The energizing of the "down" relay coil D also closes a relay contact D2. Since the relay contacts OL1, RPR1, and PE1 are all closed when relay D2 closes, voltage is passed through normally-closed relays contacts UC4 and DE2 to energize the "down" contactor relay coil DC. Relay contact DC4 opens to prevent any accidental energizing of the "up" contactor relay coil UC. Relay contact DC5 will close, and with the relay contact P1 already closed, the potential contactor relay coil PC will also energize. With the contactors DC and PC both energized, the hoist motor 242 will receive its operating voltage, causing motor rotation that will lower the elevator car 106 to the lowest landing until the Normal "Down" Limit Switch is operated by a can (not shown) fixed to the elevator frame, which will open the Normal "Down" Limit Switch, thus removing the programmable controller output signal from the "down" contractor relay coil D and allowing it to de-energize.

As the elevator travels, the control circuit elements associated with the safety columns 214*a*, 214*b* are also changing state. The relay contact D1 opens to prevent the operation of the relay coil EXT. This is to ensure that the safety columns 214*a*, 214*b* do not extend while the elevator is moving into the pit area. Most importantly, the car clear relay coil CLR is operating. As the elevator moves down into the pit, the column enable limit switch CL is operated by the switch cam 117 on the elevator frame. "down" contactor relay contact DC1 is closed, and as the column enable limit switch is operated, the RESET armature R of the relay contact CLR1, CLR will briefly receive an operating voltage, thus opening relay contact CLR1. While the relay contact CLR1 is open, the safety column operating relays cannot energize. This prevents mechanical interference or damage to both the elevator car 106 and the safety columns 214*a*, 214*b*.

When the elevator is at the first floor landing, the First Floor Zone Switch Z1 will be operated by a cam (not shown) on the elevator frame, and thereby closed. This provides a signal to the programmable controller Input 011. The Door Zone Switch will also be operated by the cam or vane located at the landing, sending signal to input 016.

While at the first floor landing, inspection service can be performed by qualified technicians. The procedure involved and the sequence of events are as follows:

Freight elevators are equipped with manually operated doors and gates, while most passenger elevator systems have power-operated doors and gates. In either case, with the doors and the car gate at the first floor landing opened, the Hall Button Cut-Out Switch 238 in the controller can be opened to prevent hall calls from the other landings. The Leveling Cut-Out Switch 240 is also opened to prevent unwanted car leveling or automatic door operation when the inspection sequence is completed. The controller inspect switch 234 is also opened for similar reasons. When the Controller Inspect Switch 234 or the Keyed Inspect Switch 122 is operated, the primary inspection relay coil IN is disabled. Relay contact IN3 is thus open, and relay contact IN2 is closed. The closing of the relay contact IN2 permits the operation of the Bottom and Top floor Access Switches 124*a*, 124*b*. At the top floor, the only access switch that would be functional is the access "up" side of the switch 124*a*, because the elevator car 106 must be physically located at that landing to operate the access zone limit switch AZT in order to operate the Top Access "down" relay coil TAD. With the elevator car 106 located at the first floor landing, the access zone limit switch AZB is operated and its contact is closed, allowing the use of the Bottom Access "up" function of the Bottom Access Switch 124*b*.

Operation of the Bottom Access switch 124*b* in the "up" position energizes bottom access relay coils BAU and BAC. The In Car Stop Switch, the Intermediate Door Contact, and the Upper Door Contact are all closed. At this time, the Lower Door Contact and Car Gate contacts are open. To operate the elevator in the "up" direction with the door and gate contacts open, AC power is routed through the In Car Stop Switch and Intermediate Door Contact. From there, AC power goes through the relay contacts BAC2 and BAU2 to the Upper Door Contact. Primary Inspection Relay Coil INT is still energized, which keeps relay contact INT1 open. From relay contact INT1, power re-routes through relay contact BAU3 over to the Normal "up" Limit Switch, where the circuit functions to operate the "up" contactor relay coil U and the other related relays, as was described for the "down" call of the elevator car 106. When the elevator travels up past the point where the Bottom Access Zone Switch AZB is operated by a cam (not shown) mounted on the elevator frame, the bottom access "up" relay coil BAU will de-energize and upward travel will cease.

During use of the bottom access switches 124*b* in the "up" position, other events are taking place in the controller and the elevator pit area. The relay contact U1 is open, thus preventing the safety column retract relay coil RET from energizing. The "up" contactor relay contact UC1 is closed so that when the elevator car 106 is high enough to operate the Column Enable Limit Switch CL, the SET armature of the car clear latching relay CLR is energized. Latching relay contact CLR1 is then closed, and will remain closed until the elevator car 106 is returned to floor level at the first floor landing. Other events which take place during the Access "up" operation are as follows:

The column "up" limit switches CLUL, CLUR are initially closed, which allows the safety column extend relay coil EXT to energize. AC power will pass through the closed limit switch and the closed relay contact D1 to the safety column extend relay coil EXT to the closed relay contact BAU1. From there, the circuit to energize safety column extend relay coil EXT passes through the energized closed relay contact BAC1 and the relay contact CLR1. Once the relay coil EXT is energized, it will he locked in by its own relay contact EXT1. It will remain energized until both of the Column "up" Limit Switches CLUL, CLUR are opened by the full travel of the safety columns 212*a*, 212*b*. Relay contacts EXT3, EXT4 provide the operating voltage for the two actuators 214*a*, 214*b* causing them to extend, which moves the safety columns 212*a*, 212*b* upright. As the safety columns 212*a*, 212*b* start to move upright, the column "down" limit switches CLDL, CLDR are allowed to return to the non-operated position, which in turn allows AC power to pass through their corresponding contacts. "Down" enable relay coil DE is energized as a result of the closed relay contact EXT1. The relay coil DE also locks itself in the energized state by its own relay contact DE1. It will remain energized until both Column "down" Limit Switches CLDL, CLDR are operated by the safety columns 212*a*, 212*b* returning to their stored positions. With relay coil DE energized, downward travel by the elevator car 106 is prohibited by the now-open relay coil DE2.

At this point, the elevator car 106 is parked about five feet above the first floor landing door sill and about six (6) feet above the pit floor. There is now sufficient room for the technician to enter the pit area for his inspection or maintenance service. The elevator still has AC power available at this time. If it was evident that the pit area was in proper operating condition, the elevator could be returned to the first floor landing with the Bottom Access Switch 124*b*. If the technician does enter the pit area, AC power will be removed from the majority of the controller circuits.

The following circuits or functions will remain operational for safety reasons. Master Control Relay MCR will remain energized along with the programmable controller AC supply through the relay contacts MCR1, MCR2. The Fire Recall Switch also remains functional. Further, the elevator safety system of the present invention remains fully functional.

Upon entering the pit, the technician's first step will land on the mat switch 230. When it does so, the mat relay coil MR will drop out or de-energize. During normal use, the mat switch operates as an open type of contact When the contact closes, a short circuit is created which removes the AC supply from the mat relay coil MR. The supply transformer 242 and fuse 214 are protected from burn-out by the use of a resistor 246 in the circuit. The resistor 246 becomes the only electrical load rather than the mat relay coil MR with the resistor 246.

When the mat relay coil MR relay drops out, the normally-closed relay contact MR5 will return to the closed condition. If the elevator had been at an upper landing (e.g., the third floor) and not in the Access mode of operation, the closing of MR5 would have caused the automatic energizing of the safety column extend relay coil EXT and the operation of the left and right actuators 214*a*, 214*b*. Since this is an Access type of operation, the actuators 214*a*, 214*b* are already in the extended position. Relay contact MR1 closes, while relay contact MRR1 is already closed. With these two contacts closed, the warning bell 248 will ring within the pit area. The bell is loud enough to be irritating to those in the pit such that, in order to silence the warning bell 248, those in the pit must get off the mat switch 230 or place the movable stop members 220*a*, 220*b* in position, whereby the frame of the elevator car 106 would come to rest on them if it were to be lowered. By placing the movable stop members 220*a*, 220*b* in position, the two Rail Safety Arm Limit Switches SML, SMR will be operated and the switch contacts SML2, SMR2 will close. Since the relay contact MR2 is closed, the SET armature of the mat circuit reset latching relay MRR will be energized. With the mat circuit reset latching relay MRR energized and in the SET state, relay contact MRR1 will open, and the warning bell 248 will cease to operate. Relay contact MR2 will be in the open state, and hence the power enable relay coil PE will be de-energized. Relay contact PE3 will close in preparation for the system reset operation to be performed later. Relay contacts PE1, PE2 and PE4 will open. These contacts serve to remove all AC power from the operational devices of the basic elevator system, with the exception of the programmable controller, The Master Control Relay MCR and the Fire Recall Switch. Relay contact MRR3 is also closed at this time; this set of contacts will be a part of the Reset Required Indicator circuit.

From this point on, the technician can perform the required service on the elevator car 106 that is electrically disabled. Mechanically, he is protected by two different sets of safety devices, movable stop members 220*a*, 220*b* and safety columns 212*a*, 212*b*. The movable stop members 220*a*, 220*b* prevent elevator car travel below the point where stop members 220*a*, 220*b* are located (typically five to six feet above the pit floor), while the electrically-positioned safety columns 212*a*, 212*b* provide the mechanical obstruction to elevator car descent which creates the ANSI Code Minimum Depth of Pit (24 inches) by raising the point of impact of the elevator frame with a pit floor device.

After performing any pit services, the system will be returned to an operational status. In order to reset the system, the movable stop members 220*a*, 220*b* must be first returned to their stored positions. When this has been done their switch contacts SML2, SMR2 will open, and the switch contacts SML1, SMR1 will close. Since relay MRR is of the latching type, the warning bell 248 will not activate at this time. Once the technician exits the pit, the mat switch surfaces SMS1, SMS2 will separate, and the mat relay coil MR will energize.

Relay contacts MR1, MR4 will open, disabling circuits for the warning bell 248 and the SET armature S of the latching relay MRR relay. Relay contacts MR5 will open, and relay contacts MR2, MR3 will close. The Reset Required Indicator 250 will illuminate in the elevator controller enclosure (not shown). At this point, operation of the Reset button 252 will energize the RESET armature R of the latching relay MRR. Relay contacts MRR1, MRR2 will close, and the relay contact MRR3 will open. The power enable relay coil PE will energize, and the relay contact PE3 will open. Relay contacts PE1, PE2, PE4 will all close. The elevator controller is at that point ready for the Access "down" operation. If entrance into the pit area were to take place again, the elevator safety circuits would function again as previously explained.

To fully recover from the above Access Inspection procedure, the Bottom Access Switch 124*b* at the first floor landing must be used. By holding the Bottom Access Switch 124*b* in the "down" position, bottom access relay coils BAC and BAD will be energized. As in the Access "up" operation, the open first floor landing door and the open car gate circuit will be bypassed by the relay coils BAC and BAD, and the relay coils D, DIL, and P will be energized. Elevator travel in the "down" direction is prevented by the open relay contact DE2. Relay coil DE was initially energized at the beginning of the "up" Access position of the inspection procedures.

By holding the Bottom Access Switch 124*b* in the "down" position when the relay contacts BAD1 and BAC1 close, relay contact CLR1 of latching relay CLR is still closed, and this circuit will cause the safety column retract relay coil RET to energize. The relay coil EXT cannot accidentally energize because of the open relay contact D1. Relay contacts RET1, RET2 of relay coil RET will close, allowing AC power to be sent to the left and right actuators 214*a*, 214*b* so that the safety columns 212*a*, 212*b* will be moved to their retracted positions. As the safety columns 212*a*, 212*b* move, the column "up" limit switches CLUL, CLUR will close. When the safety columns 212*a*, 212*b* are fully retracted, the column "down" limit switches CLDL, CLDR will open. When both sets of column "down" limit switches CLDL, CLDR have opened, the relay coils RET and DE will be energized.

The relay contact DE2 closes and the "down" contactor relay coil DC for downward travel will energize. The elevator car 106 will then move down to the Normal "Down" Limit Switch. Downward travel is still dependent on the technician holding the Bottom Access Switch 124*b* to the "down" position. While the elevator is moving down, the Column Enable Limit Switch CL will be operated by the movement of the elevator car 106. While the "down" contactor relay contact DC1 remains closed, the RESET armature R of the latching relay CLR will be momentarily energized. The relay contact CLR1 will open, disabling relay coils EXT, RET and DE. After elevator car travel is disabled by the opening of the Normal "Down" Limit Switch, the technicians will be able to return all of the inspection switches to their normal configuration for normal elevator operation.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A safety system for an elevator car positioned above a pit, the system comprising:

a) one or more fixed stop members integrally fixed to the car;

b) one or more safety columns that are pivotable between:

1) an extended position in which the one or more safety columns are vertically aligned with the one or more fixed stop members so as to prevent the car from descending below a first vertical height in the pit; and 2) a retracted position in which the one or more safety columns are clear of the car including the one or more fixed stop members;

c) means for automatically pivoting the one or more safety columns into the extended position in response to positioning of the car;

d) one or more rails extending up from the pit; and e) one or more movable stop members that are attached to the one or more rails and that are movable between:

1) a first position, in which the one or more movable stop members are vertically aligned with the car so as to prevent the car from descending below a second vertical height; and 2) a second position, in which the one or more movable stop members are clear of the car.

2. The system of claim 1, wherein:

the first vertical height is smaller than the second vertical height.

3. An elevator safety system for an elevator car positioned in an elevator shaft above a pit, the system comprising:

a) a motor for moving the car vertically in the shaft;

b) means for sensing an object, such as an person, on the pit's floor directly below the elevator car and for signalling presence or absence of the object in the pit;

c) a warning indicator that, when activated, can be sensed by a person in the pit;

d) one or more movable stop members that are movable between:

1) a first position, in which the one or more movable stop members are vertically aligned with the car so as to prevent the car from descending below a predetermined height in the pit; and 2) a second position, in which the one or more movable stop members are clear of the car; and e) means for activating the warning indicator when the sensing means signals the presence of the object unless the one or more movable stop members have been moved into the first position preventing descent of the car below the predetermined height.

4. The system of claim 3, wherein:

the sensing means includes a pressure-sensitive mat that is disposed in the pit directly below the elevator car and that senses a weight exerted by a person when on the mat.

5. The system of claim 3, wherein:

the warning indicator is a loud audible warning indicator.

6. The system of claim 3, wherein:

the system further comprises one or more movable stop member position sensors that are associated with the one or more movable stop members and that signal whether the one or more movable stop members are in the first position or the second position; and the means for activating includes an arrangement of electromechanical elements that are responsive to the sensing means and to the one or more movable stop member position sensors, and to which the warning indicator is responsive.

7. The system of claim 3, wherein the activating means constitutes:

means for automatically activating the warning indicator when the sensing means signals the presence of the object unless the one or more movable stop members have been moved into the first position preventing descent of the car below the predetermined height.

8. The system of claim 3, further comprising:

means for cutting power to the motor when the sensing means signals the presence of the object, so that the motor cannot move the car downward to the bottom of the shaft.

* * * * *